US008011958B1

(12) United States Patent
Guo et al.

(10) Patent No.: US 8,011,958 B1
(45) Date of Patent: Sep. 6, 2011

(54) E-EASY SERIES CONNECTOR ASSEMBLY WITH SHIELDING FUNCTION

(75) Inventors: Rongzhe Guo, Shenzhen (CN); Yaohua Hou, Shenzhen (CN)

(73) Assignee: Amphenol East Asia Electronic Technology (Shenzhen) Ltd., Shenzhen, Guangdong Province (CN)

( * ) Notice: Subject to any disclaimer, the term of this patent is extended or adjusted under 35 U.S.C. 154(b) by 0 days.

(21) Appl. No.: 12/782,721

(22) Filed: May 19, 2010

(51) Int. Cl.
*H01R 13/648* (2006.01)

(52) U.S. Cl. ..... 439/607.17; 439/607.28; 439/352

(58) Field of Classification Search ..... 439/607.13, 439/607.17–607.19, 607.28–607.3, 607.47, 439/352, 357, 358
See application file for complete search history.

(56) References Cited

U.S. PATENT DOCUMENTS

| | | | | |
|---|---|---|---|---|
| 5,766,041 | A * | 6/1998 | Morin et al. | 439/607.19 |
| 6,364,707 | B1 * | 4/2002 | Wang | 439/607.53 |
| 6,368,153 | B1 * | 4/2002 | Hwang | 439/607.2 |
| 6,379,185 | B2 * | 4/2002 | Belopolsky et al. | 439/607.38 |
| 6,416,361 | B1 * | 7/2002 | Hwang | 439/607.2 |
| 6,450,837 | B1 * | 9/2002 | Givens et al. | 439/620.19 |
| 6,660,933 | B2 * | 12/2003 | Festag | 174/359 |
| 6,682,368 | B2 * | 1/2004 | Murr et al. | 439/607.28 |
| 7,001,217 | B2 * | 2/2006 | Bright et al. | 439/607.2 |
| 7,097,507 | B1 * | 8/2006 | Zhang et al. | 439/607.35 |
| 7,114,981 | B1 * | 10/2006 | Huang et al. | 439/353 |
| 7,491,090 | B2 * | 2/2009 | Oki et al. | 439/607.17 |
| 7,530,845 | B1 * | 5/2009 | Yang | 439/607.01 |
| 7,557,306 | B2 * | 7/2009 | Chen et al. | 174/382 |
| 7,568,950 | B2 * | 8/2009 | Belopolsky et al. | 439/607.55 |
| 7,704,098 | B2 * | 4/2010 | Lambie et al. | 439/607.28 |
| 7,758,381 | B2 * | 7/2010 | Oki | 439/607.28 |
| 7,794,262 | B2 * | 9/2010 | Briant et al. | 439/352 |
| 7,857,662 | B2 * | 12/2010 | Gillespie et al. | 439/607.3 |
| 7,869,224 | B1 * | 1/2011 | Yang | 361/800 |
| 7,901,221 | B1 * | 3/2011 | Li et al. | 439/95 |
| 2003/0100204 | A1 * | 5/2003 | Hwang | 439/92 |
| 2009/0124127 | A1 * | 5/2009 | Zhang et al. | 439/607.38 |
| 2009/0264018 | A1 * | 10/2009 | Weber et al. | 439/607.17 |
| 2010/0079971 | A1 * | 4/2010 | Gillespie et al. | 361/816 |

* cited by examiner

*Primary Examiner* — Ross N Gushi
(74) *Attorney, Agent, or Firm* — Leong C. Lei

(57) ABSTRACT

Disclosed is an electrical connector assembly with shielding function, includes a cable-end connector and a board-mount connector that are mateable with each other. The board-mount connector includes a metal shell, an insulation housing received in the metal shell, and conductive terminals mounted inside the insulation housing. The cable-end connector includes an upper metal shell member, a lower metal shell member, a cable clamp, an insulation housing received between the upper metal shell member and the lower metal shell member, conductive female terminals mounted inside the insulation housing, and resilient latches and a pull bar mounted to the lower metal shell member. The metal shell of the board-mount connector has top and bottom surfaces each forming shielding contact tabs, which are folded outward and each forming a protruding inside contact point and a protruding outside contact point and reliable contact is thus formed among the connectors and a device panel.

4 Claims, 4 Drawing Sheets

E-EASY SERIES CONNECTOR ASSEMBLY WITH SHIELDING FUNCTION

(a) TECHNICAL FIELD OF THE INVENTION

The present invention generally relates to the technical field of connector and cable assembly for telecommunication.

(b) DESCRIPTION OF THE PRIOR ART

Heretofore, a connector is provided various shielding contact tabs for respectively engaging a device panel to which the connector is to be mounted and a cable end connector that is to mate the connector. This arrangement requires a great number of shielding contact tabs provided on the connector in order to ensure similar functional reliability of engagement for shielding purposes. Consequently, a large normal force needs to be applied to the shielding contact tabs. This affects the difficulty of mounting a board mount connector to a device carrying the connector and further, such an arrangement is complicated and bulky, leading to high costs.

SUMMARY OF THE INVENTION

The technical problem that the present invention intends to solve is to provide an E-easy series connector assembly with shielding function, which provides excellent electromagnetic interference (EMI) shielding effect and is also simple in structure, easy to install, and cheap in cost.

To solve the above mentioned technical problem, the solution adopted by the present invention is an E-easy series connector assembly with shielding function, which comprises a cable end connector and a board-mount connector that are mateable with each other. The board-mount connector comprises a metal shell, an insulation housing received inside the metal shell, and conductive terminals mounted inside the insulation housing. The cable-end connector comprises an upper metal shell member, a lower metal shell member, a cable clamp, a latching assembly, an insulation housing, and conductive terminals. The metal shell of the board-mount connector has top and bottom surfaces each forming shielding contact tabs. The shielding contact tabs are folded outward and each shielding contact tab forms a protruding inside contact point and a protruding outside contact point. Both the top and bottom surfaces of the metal shell are provided with a plurality of shielding contact tabs, each of which realizes a reliable contact between the board-mount connector and the cable-end connector and also a reliable contact between the board-mount connector and a device panel. Once the connectors are properly fit to each other, the outside contact points are set in contact engagement with the device panel, while the inside contact points are in engagement with metal plates covering the cable-end connector. The insertion of the cable-end connector forces the shielding contact tabs to flex outward, resulting in a reliable contact between the shielding contact tabs and the device panel. In this way, the shielding contact tabs provide a sufficient clamping force in opposite directions, ensuring the reliable contact established among the board-mount connector, the cable-end connector, and the device panel thereby realizing excellent performance of electromagnetic interference (EMI) shielding for the connector assembly.

According to the present invention, the upper metal shell member and the lower metal shell member of the cable-end connector are provided, on opposite sides thereof, with a locking device that comprises resilient latches and a pull bar arranged at corresponding locations. Each of the resilient latches has a front end section forming a locker pawl and an inclined surface. The pull bar has a front end forming a projection block corresponding to each resilient latch and having a slope engageable with the resilient latch. When the pull bar is pulled rearward, the projection blocks of the pull bar and the inclined surfaces of the resilient latches interact with each other, forcing the front end sections of the resilient latches to deflect outward and thus disengaging the locker pawls of the resilient latches from side walls of the board-mount connector thereby realizing unlocking and thus allowing easy separation of the cable-end connector and the board-mount connector from each other. Once the force applied to the pull bar is removed, the spring force induced by the resilient latches brings the locker pawls back to the original position, and due to the interaction between the projection blocks and the inclined surfaces, the pull bar is returned to the original position. Thus, with no external force applied to the pull bar, this arrangement ensures that the board-mount connector and the cable-end connector are securely locked together.

According to the present invention, the cable clamp has a cable engaging surface that forms rotation prevention barbs, and a flange is formed to extend from an end of the cable clamp. The rotation prevention barbs ensure excellent fixation of a cable received in the cable-end connector, once the cable clamp is secured in position by bolts or fasteners, effectively preventing the cable from rotation and getting loosened. The flange that is formed at the end of the cable clamp reinforces the structural strength of the cable clamp and ensures sufficient stiffness in clamping the cable.

As compared to the existing devices, the present invention offers the following advantages:

The shielding contact tabs are constructed with a unique shape that allows each shielding contact tab to physically contact a device panel and also in physical engagement with the cable-end connector. When the cable-end connector 2 is inserted, an additional normal force is provided to the shielding contact tabs for establishing reliable shielding performance. The structure shows functional reliability, ease of use, simplified structure, size compactness, and low cost.

The locking device has a unique structure composed of a pull bar and two resilient latches, so that connection and disconnection of the connector assembly are made easy and efficient connection and the amount of space needed in carrying connection and disconnection is small. Thus, the connector assembly of the present invention can be used in a high-density side-by-side arrangement. The connector assembly of the present invention has a small and compact outside configuration, which is in favor of miniaturization of a corresponding device.

The cable clamp that is provided with rotation prevention barbs and a flange can effectively prevent a cable received therein from undesired loosening and/or rotation and also show enhanced stiffness.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
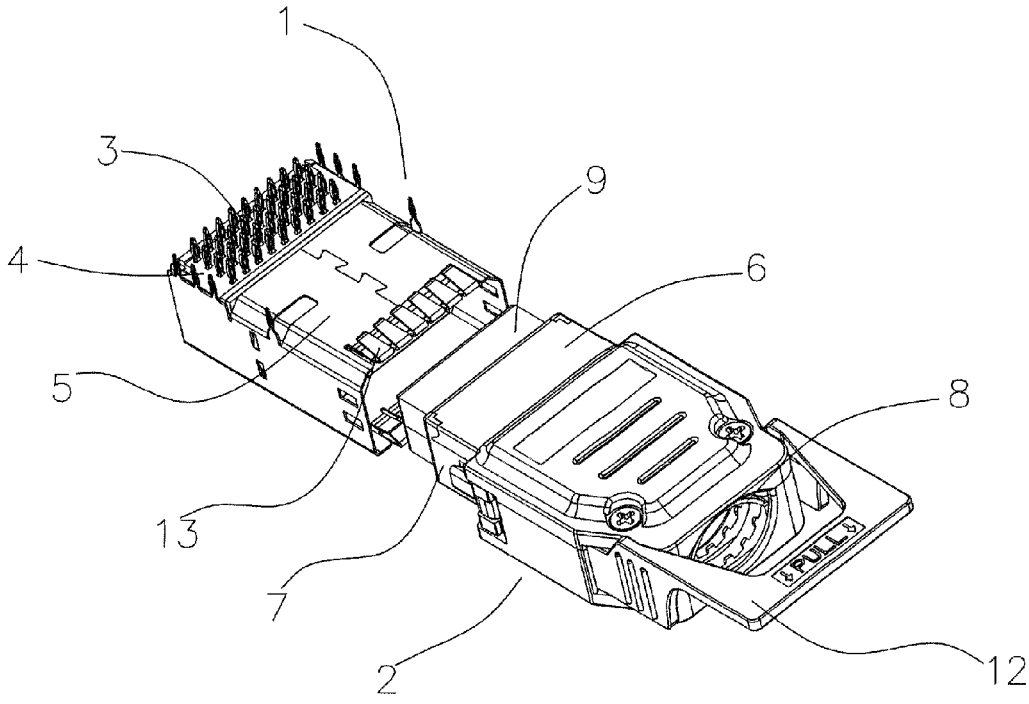
FIG. 1 is a perspective view showing a connector assembly according to the present invention.
Figure 2:
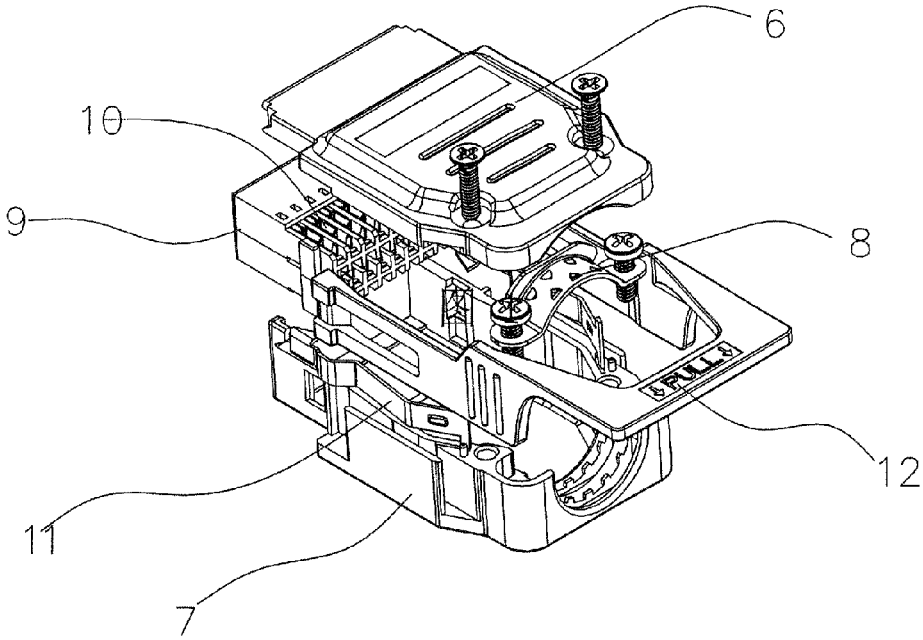
FIG. 2 is an exploded view showing a cable-end connector of the connector assembly according to the present invention.
Figure 3:
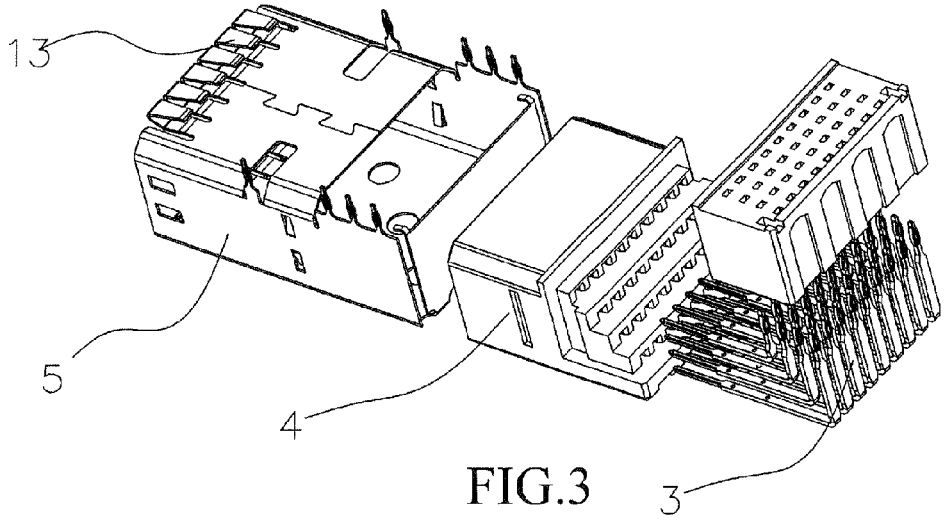
FIG. 3 is an exploded view showing a board-mount connector of the connector assembly according to the present invention.
Figure 4:
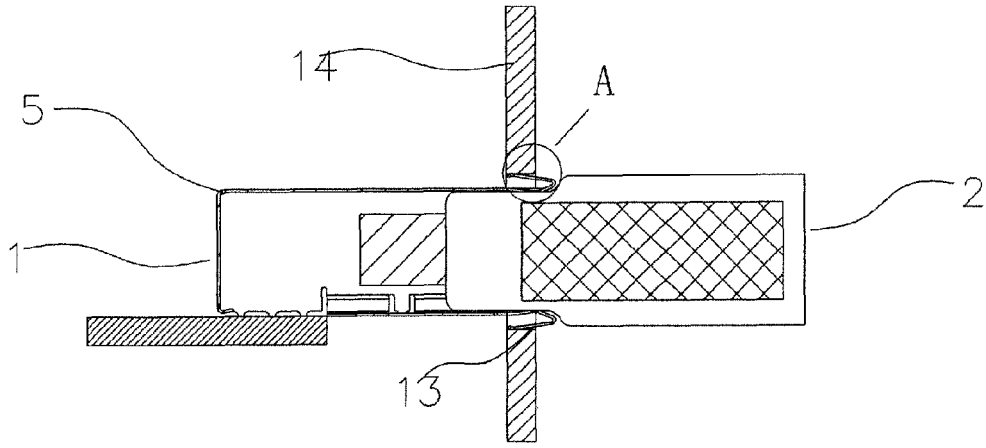
FIG. 4 is a side elevational view showing spatial relationship among the cable-end connector, the board-mount connector, and a device panel.
Figure 7:
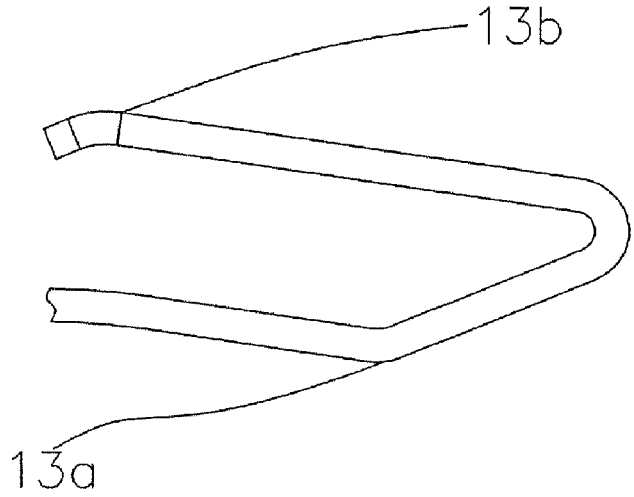
FIG. 7 is a magnified view of a circled portion A of FIG. 4.

Referring to FIGS. 1 and 4, the present invention provides an E-easy connector assembly with shielding function, which comprises a cable-end connector 2 and a board-mount connector 1. As shown in FIG. 3, the board-mount connector 1 comprises a metal shell 5, an insulation housing 4 received inside the metal shell 5, and conductive terminals 3 mounted inside the insulation housing 4. In the embodiment illustrated, the metal shell 5 is a shell made of a ferrous material. As shown in FIG. 2, the cable-end connector 2 comprises an upper metal shell member 6, a lower metal shell member 7, a cable clamp 8, an insulation housing 9 received between the upper metal shell member 6 and the lower metal shell member 7, conductive female terminals 10 mounted inside the insulation housing 9, and resilient latches 11 and a pull bar 12 mounted to the lower metal shell member 7. The upper metal shell member 6 and the lower metal shell member 7 together form a shell for the cable-end connector 2. As shown in FIGS. 3 and 7, the metal shell 5 of the board-mount connector 1 has top and bottom surfaces each forming shielding contact tabs 13. The shielding contact tabs 13 are folded outward and each shielding contact tab forms an inside contact point 13*a* and an outside contact point 13*b*, both protruding outward. Both the top and bottom surfaces of the metal shell are provided with a plurality of shielding contact tabs 13, which realize reliable contact between the board-mount connector 1 and the cable-end connector 2 and also reliable contact between the board-mount connector 1 and a device panel 14. Once the connectors are properly fit to each other, the outside contact points 13*b* are set in contact engagement with the device panel 14, while the inside contact points 13*a* are in engagement with the upper metal shell member 6 and the lower metal shell member 7 of the cable-end connector 2. The insertion of the cable-end connector 2 forces the shielding contact tabs 13 to flex outward, resulting in reliable contact between the shielding contact tabs 13 and the device panel 14. In this way, the shielding contact tabs 13 provide a sufficient clamping force in opposite directions, ensuring the reliable contact established among the board-mount connector 1, the cable-end connector 2, and the device panel 14 thereby realizing excellent performance of electromagnetic interference (EMI) shielding for the connector assembly.

Figure 5:
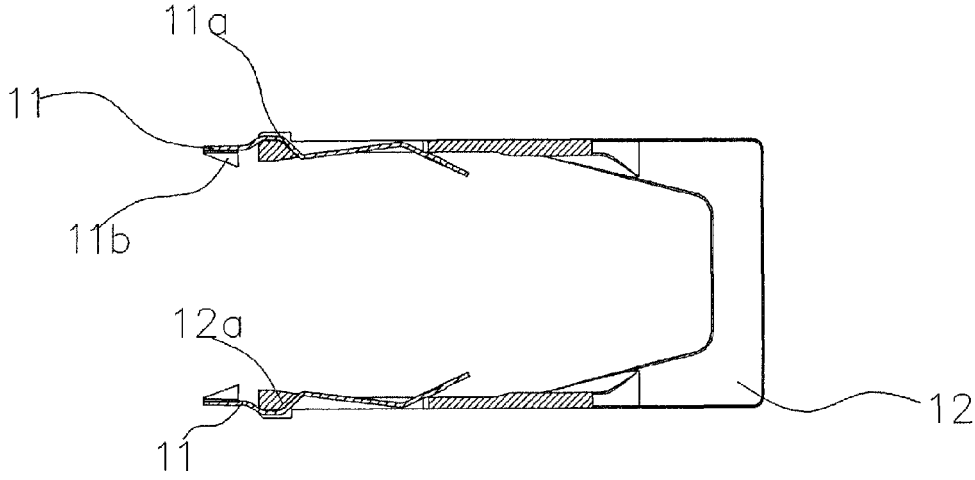
FIG. 5 is a schematic view showing a locking device incorporated in the connector assembly according to the present invention.

As shown in FIG. 5, the upper metal shell member 6 and the lower metal shell member 7 are provided, on opposite sides thereof, with a locking device that comprises resilient latches 11 and a pull bar 12 arranged at corresponding locations. Each of the resilient latches 11 has a front end section forming a locker pawl 11*b* and an inclined surface 11*a*. The pull bar 12 has limbs corresponding to the latches 11 and each having a front end forming a projection block 12*a*, which has a slope engageable with the respective resilient latch 11. When the pull bar 12 is pulled rearward, the projection blocks 12*a* of the pull bar 12 and the inclined surfaces 11*a* of the resilient latches 11 interact with each other, forcing the front end sections of the resilient latches 11 to deflect outward and thus disengaging the locker pawls 11*b* of the resilient latches 11 from side walls of the board-mount connector 1 thereby realizing unlocking and thus allowing easy separation of the cable-end connector 2 and the board-mount connector 1 from each other. Once the force applied to the pull bar 12 is removed, due to the interaction between the projection blocks 12*a* and the inclined surfaces 11*a*, the spring force induced by the resilient latches 11 brings the locker pawls 11*b* back to the original position and returns the pull bar 12. Thus, when the two connectors are fit to each other, with no external force applied to the pull bar 12, this arrangement ensures that the board-mount connector and the cable-end connector are securely locked together.

Figure 6:
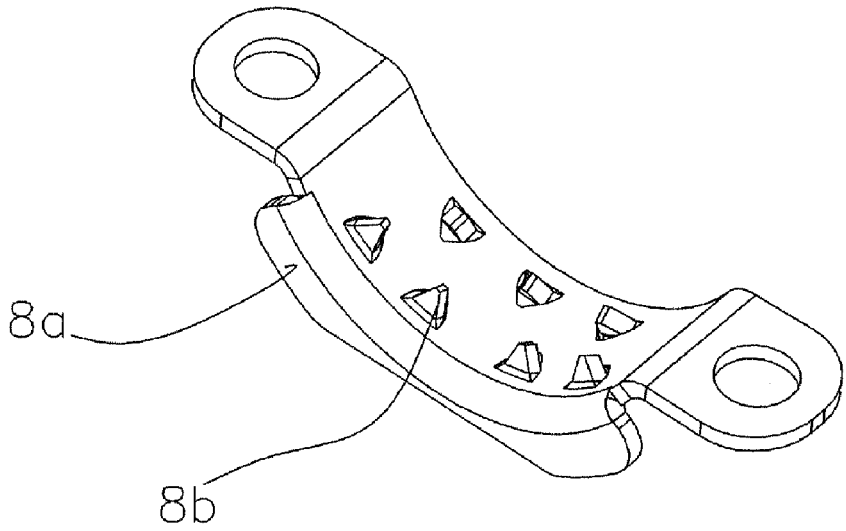
FIG. 6 is a perspective view showing a cable clamp of the cable-end connector according to the present invention.

As shown in FIG. 6, a cable is received in the cable-end connector 2, and to securely fix the cable, the cable clamp 8 has a cable engaging surface that forms rotation prevention barbs 8*b*, and a flange 8*a* is formed to extend from an end of the cable clamp 8. The rotation prevention barbs 8*b* that are formed by partially breaking off the clamp and erected at an angle of around 30-90 degrees ensure excellent fixation of the cable once the cable clamp 8 is secured in position by bolts or fasteners, effectively preventing the cable from rotation and getting loosened. The flange 8*a* that is formed at the end of the cable clamp 8 reinforces the structural strength of the cable clamp 8 and ensures sufficient stiffness in clamping the cable.

According to the present invention, the shielding contact tabs 13 are provided with inside contact points 13*a* and outside contact points 13*b*, whereby when the cable-end connector 2 and the board-mount connector 1 are fit together, the shielding contact tabs 13 provide a sufficient clamping force in opposite directions, ensuring reliable contact established among the cable-end connector 2, the board-mount connector 1, and the device panel 14, thereby realizing excellent performance of EMI shielding for the connector assembly. The cooperative arrangement of the pull bar 12 and the resilient latches 11 realizes easy and efficient connection and disconnection of the connector assembly. The cable clamp 8 is provided with rotation prevention barbs 8*b* and a flange 8*a*, so that the cable clamp 8 can effectively prevent the cable received therein from undesired rotation and/or loosening and also show enhanced stiffness.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. An E-easy series connector assembly with shielding function, comprising a cable-end connector and a board-mount connector that are mateable with each other, the board-mount connector comprising a metal shell, an insulation housing received in the metal shell, and conductive terminals mounted inside the insulation housing, the cable-end connector comprising an upper metal shell member, a lower metal shell member, a cable clamp, an insulation housing received between the upper metal shell member and the lower metal shell member; conductive female terminals mounted inside the insulation housing, and resilient latches and a pull bar mounted to the lower metal shell member, characterized in that the metal shell of the board-mount connector has top and bottom surfaces each forming shielding contact tabs, which are folded outward and each forming a protruding inside contact point and a protruding outside contact point.

2. The E-easy series connector assembly with shielding function according to claim 1, characterized in that the upper metal shell member and the lower metal shell member of the cable-end connector are provided at opposite sides thereof with a locking device that is composed of the resilient latches and the pull bar arranged corresponding locations, each of the resilient latches having a front end section forming a locker pawl and an inclined surface, the pull bar having a front end forming a projection block corresponding to each resilient latch, the projection block forming a slope engageable with the resilient latch.

3. The E-easy series connector assembly with shielding function according to claim 2, characterized in that the cable clamp has a cable engaging surface on which rotation prevention barbs are formed.

4. The E-easy series connector assembly with shielding function according to claim 3, characterized in that the cable clamp has an end from which a flange extends.

* * * * *